United States Patent [19]

Strate

[11] Patent Number: 4,640,570

[45] Date of Patent: Feb. 3, 1987

[54] ELECTRICAL CONE CONNECTOR

[75] Inventor: Edward A. Strate, Los Angeles, Calif.

[73] Assignee: The United States of America as represented by the Secretary of the Air Force, Washington, D.C.

[21] Appl. No.: 785,690

[22] Filed: Oct. 9, 1985

[51] Int. Cl.[4] ..... H01R 13/50

[52] U.S. Cl. ..... 339/182 R; 339/94 C; 339/263 R

[58] Field of Search ..... 339/182, 183, 60 M, 339/94 R, 94 M, 94 C, 177 R, 177 E, 263 R

[56] References Cited

U.S. PATENT DOCUMENTS

| | | | |
|---|---|---|---|
| 2,645,759 | 7/1953 | Solari | 339/182 RS |
| 2,749,526 | 6/1956 | Petersen | 339/61 |
| 2,801,399 | 7/1957 | Dunn et al. | 339/224 |
| 3,060,417 | 10/1962 | Blake | 339/182 R |
| 3,154,360 | 10/1964 | Plishner | 339/183 |
| 3,514,741 | 5/1970 | Noren | 339/60 |
| 3,665,509 | 5/1972 | Elkins | 339/12 V |
| 3,879,097 | 4/1975 | Oertle | 339/94 R |

*Primary Examiner*—Gil Weidenfeld
*Assistant Examiner*—David L. Pirlot
*Attorney, Agent, or Firm*—William G. Auton; Donald J. Singer

[57] ABSTRACT

The electrical interface of two sets of wires is accomplished with the use of a conically shaped male plug, a female socket, an indexing key and a self locking center bolt. The male plug terminates a first set of wires in a plurality of contacts on its conically shaped mating surface. The female socket terminates a second set of wires in a concave conical surface which is complementary to the mating surface of the male plug. The self locking center bolt is inserted through the female socket into an insert within the male plug, and provides a means for early engagement and locking between the male plug and female socket that prevents contacts from prematurely making any contact. The indexing key is a longitudinal protrusion on the female socket which fits into a complementary slot on the male plug to align the contacts of the first and second set of wires to ensure a proper connection between the two sets of wires.

4 Claims, 5 Drawing Figures

ELECTRICAL CONE CONNECTOR

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to electrical connectors and more specifically to a conically shaped multi-contact electrical connector.

The provision of a large number of terminals within a single connector fitting presents a variety of difficulties. These difficulties include the problem of bent and broken small pin contacts, inadequate seals, and a need for a high engagement and separating force in the difficult task of removing, changing and reworking wire connections.

The task of improving multi-contact electrical connectors has been alleviated, to some degree, by the following U.S. Patents, which are incorporated herein by reference:

U.S. Pat. No. 3,665,509 issued to Elkins on May 23, 1972;

U.S Pat. No. 2,801,399 issued to Dunn et al on July 30, 1957;

U.S. Pat. No. 2,749,526 issued to Petersen on June 5, 1956; and

U.S. Pat. No. 3,514,741 issued to Noren on May 26, 1970.

The Elkins, Dunn and Noren references each disclose conical shaped electrical connectors. The electrical connector of Elkins includes a conical shaped plug having contact rings and a vacuum attachment chuck to seat the plug in a mating socket. The Petersen reference discloses a multi-contact connector including an elastic plug and socket members having complementary conically shaped mating telescoping surfaces.

The use of conically shaped electrical connectors helps reduce seizing between mating connectors but there remains the possibility of touching contacts of different circuits. In view of the foregoing discussion, it is apparent that there currently exists the need for a conically shaped multi-contact electrical connector which prevents the touching of contacts of different circuits, and possesses a number of layers of contacts around complementary shaped surfaces. The present invention is intended to satisfy that need.

SUMMARY OF THE INVENTION

The present invention includes an electrical connector which consists of a male and female plastic cone with a number of layers of contacts around the cone. The two cones are indexed by a key and pulled tightly together with a hand tightened, self locking center bolt.

The lone attaching center bolt prevents the touching of contacts of different circuits during assembly of the male and female connectors. The contacts of the male and female are 0.002 and 0.005 inches above the plastic to always insure contact to contact engagement. There is an 'O' ring seal between the male and female connector and an 'O' ring seal between the center bolt and the female connector to prevent moisture from entering the connectors.

It is a principal object of the present invention to provide an improved multi-contact electrical connector.

It is another object of the present invention to provide a multi-contact electrical connector with a design which prevents complementary plugs from seizing.

It is another object of the present invention to provide a multi-contact electrical connector which prevents the touching of contacts of different circuits.

It is another object of the present invention to provide a multi-contact electrical connector which prevents moisture from entering the complementary connectors.

These together with other objects features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

Figure 1:
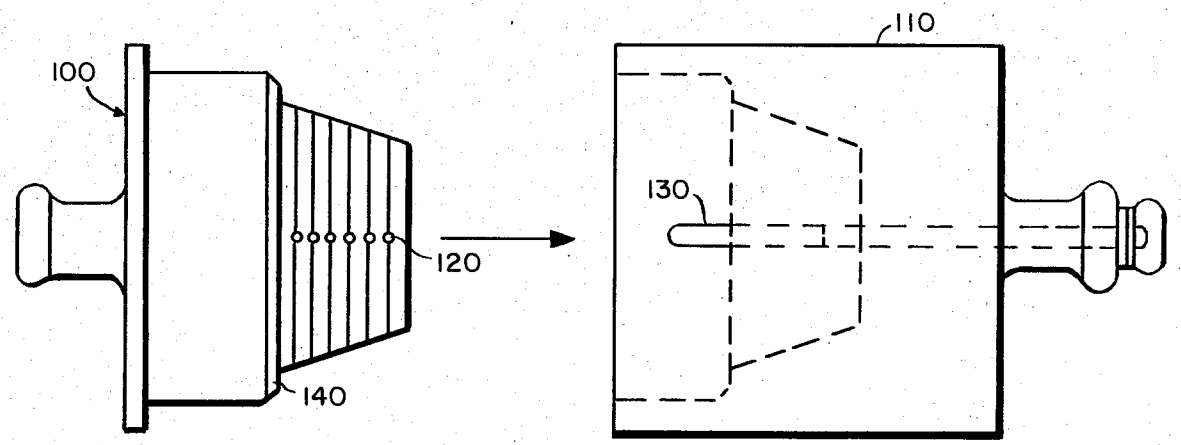
FIG. 1 depicts the preferred embodiment of the present invention.

The present invention is a multi-contact electrical connector. The reader's attention is now directed to FIG. 1 which depicts the preferred embodiment of the present invention. As depicted in FIG. 1, the electrical connector consists of a male 100 and female 110 plastic cone with a number of layers of contacts 100 around the cone. The two cones (15° cone, 30° included angle) are indexed by a key and pulled tightly together with a hand tightened, self locking center bolt 130. The 15° cone angle prevents the two cones from seizing. The lone attaching center bolt prevents the touching of contacts of different circuits during assembly of the male and female connectors. The contacts of the male and female are 0.002 and 0.005 inches above the plastic to always insure contact to contact engagement.

There is an 'O' ring seal between the male and female connector and an 'O' ring seal between the center bolt and the female connector to prevent moisture from entering the connectors. These 'O' ring seals are depicted in greater detail in FIG. 3, which is discussed below. Both of these 'O' shaped rings sit in annular slots around the inner perimeter of the female plug, however, the annular slots could just as easily be placed in the male connector and center bolt. The air gap between the two cones is very small, 0.004 to 0.010 inches and should not present a moisture problem.

In another embodiment of the invention, the gap is eliminated by moving the plastic back 0.032 inches below the male contact surface and adding a resilient silicone seal around the outside of the male cone that is at the same level as the contacts. The soft seal always permits full engagement of the male and female contacts. The silicone seal is indexed and held in position by the contacts and can be bonded to the sides of the contacts. The male and female cone angles can also be ground to zero tolerance to assure full engagement of all contacts.

Figure 2:
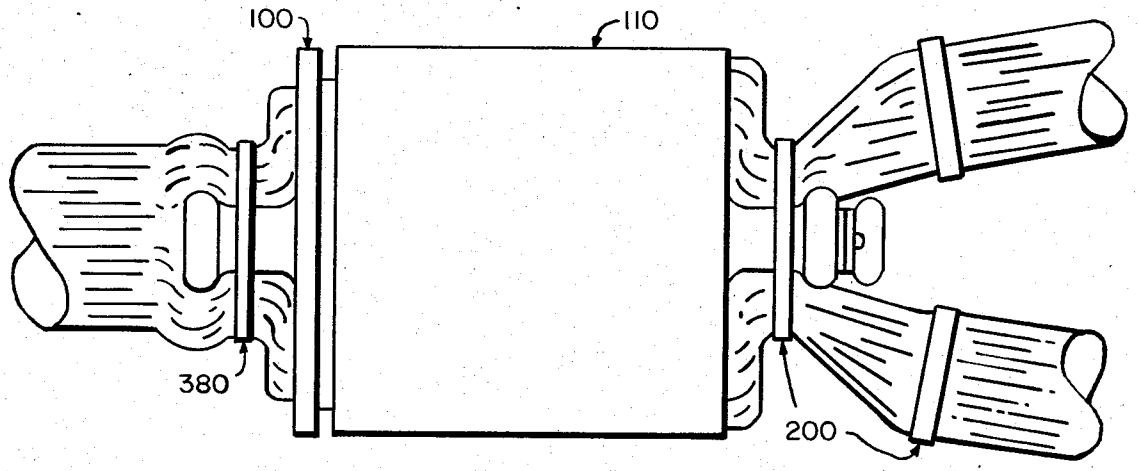
FIG. 2 is a view of the electrical connector of FIG. 1 with its complementary male and female connectors engaged.

FIG. 2 is a view of the electrical cone connector of FIG. 1 with the complementary male and female connectors engaged and connecting a plurality of wires 200. As indicated in FIG. 2, the electrical cone connector is designed so the contacts and wires are near the outside diameter of the connector while the connector attachment (center bolt) is in the center of the connector. Many of the present connectors have the contacts in the center of the connector and the attaching hardware around the outside diameter. The placing of the contacts near the outside diameter instead of around the center, greatly increase the number of contacts.

Another feature of the conically shaped connectors of the present invention is that a small increase in the connector diameter provides a large increase in the number of contacts. For example, four different designs were developed. Two with crimp (wire) attachments and two with screw (wire) attachments. The 2 ½ inch diameter (crimp) connector had 188 contacts; the 3 ½ inch diameter (crimp) connector had 363 contacts; the 2 29/32 inch diameter (screw) connector had 132 contacts; and the 3 29/32 inch diameter (screw) connector had 248 contacts.

Figure 3:
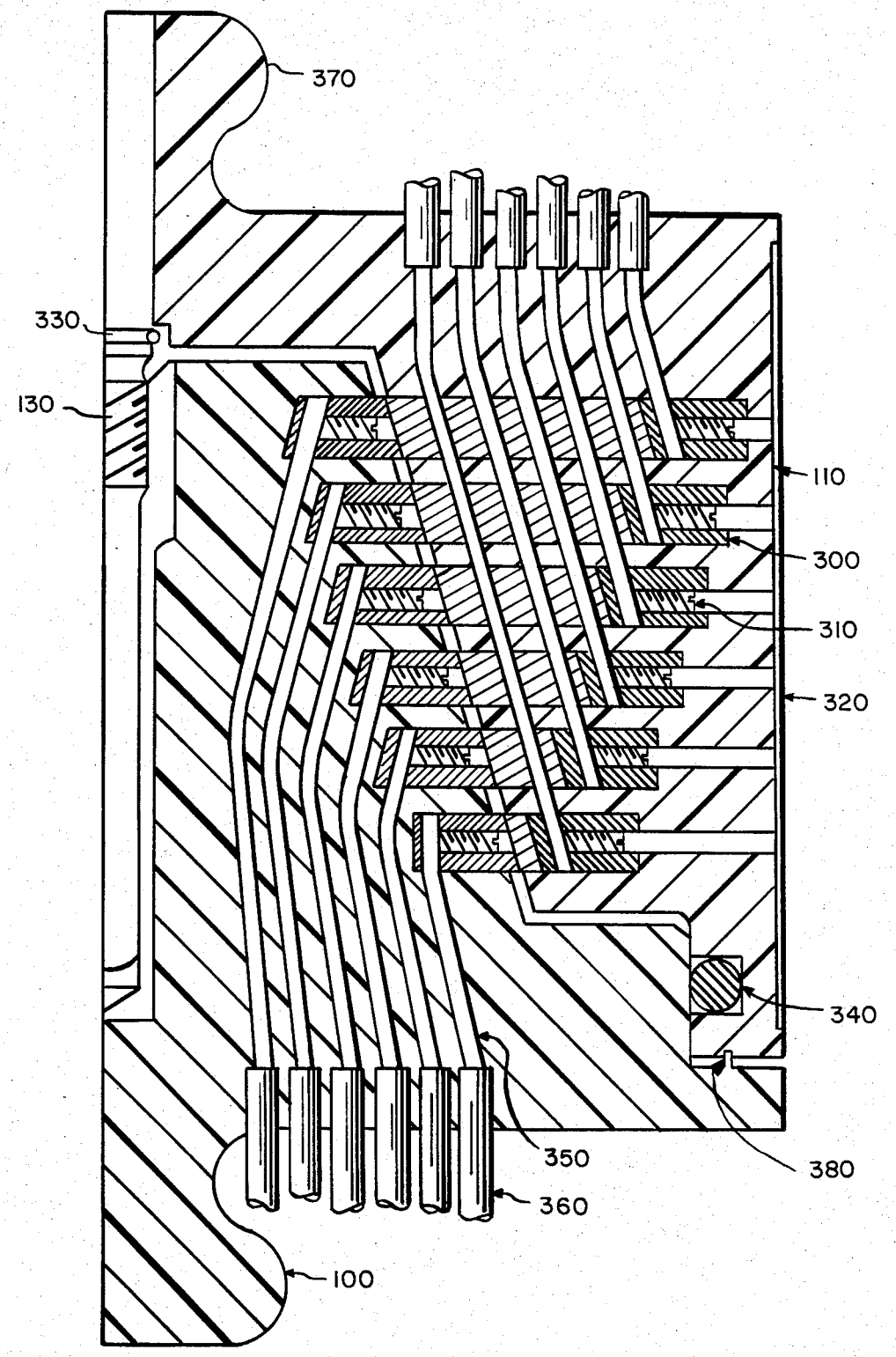
FIG. 3 is a sectional view of the lower half of a longitudinally split electrical connector of FIG. 2.

FIG. 3 is a four times size sectional view of the lower half of a longitudinally split 2 ½ inch diameter cone connector with its complementary male and female connectors engaged, as depicted in FIG. 2.

The male 100 and female 110 connectors consist of: (a) levels of contacts 120 around the cone molded into plastic shell, (b) a center threaded insert 130 molded into the plastic shell, (c) a wire attaching post 370 which is part of the plastic molding, (d) screw wire locking sockets 300, (e) sealing for the wires and between the connectors and (f) an indexing key 380 which is part of the plastic shell.

There are 6 layers of contacts 300 imbedded in the plastic with the wire end of the contact extending out of the plastic for attaching to the crimp sockets. The contact diameter at the cone surface is 0.062 inches. The connecting part of contact is 0.042 inches in diameter for 20 gauge wire. The contacts of the male and female connector extend out of the plastic 0.002 to 0.005 inches. This arrangement is simple, always provides contact to contact engagement an d a minimum air gap. Note that a zero air gap can be obtained when a resilient silicone seal is stretched around the male connector in the contact area and bonded to the sides of the contacts. The silicone seal would provide zero air gap but always positive contact engagement due to the resilient silicone. The number of contacts per level in the 2 ½ inch diameter connector are noted below in Table 1.

TABLE 1

| level | No of contacts | Male connector sockets | Female connector sockets |
|---|---|---|---|
| 1 | 45 | 45 | 45 |
| 2 | 41 | 41 | 41 |
| 3 | 35 | 35 | 35 |
| 4 | 29 | 29 | 29 |
| 5 | 22 | 22 | 22 |
| 6 | 16 | 16 | 16 |
| Total | 188 | | |

The number of contacts and sockets at each level are identical as noted above. The number is usually determined by the number of sockets in the male connector because the wire sockets are closer to the center line of the connector. All contacts go from the same level of contacts to the same level of sockets. Contacts are all identical at the same level. The socket and (contact) pins are presented in a 10 times size view in FIG. 4. The ends of the pins extend out of the plastic. The sockets, that connect to the pins are crimped to the wires. The clips that retain the sockets are designed to engage the chamfer. This will permit the socket to be pulled out of the connector, or inserted, without tools. The chamfered attachment between the clips and sockets will resist a pull-out force of 6 lbs. for twenty contacts. The 6 .lb pull-out force is identical to the crimp retention strength. Note that the pins or sockets can not be pushed out of this type of connector. Push-out of a pin or socket is a very serious problem in present connectors and requires a very large retention force. The geometry of the wires arrangement when leaving the connector, the strapping of the wires to the connector and the elimination of the push-out problem reduce the requirement for a high retention force. No tools are required to engage or disengage the sockets from the pins.

The threaded insert 130 in the male connector is molded into the plastic shell on the shell center line. The center bolt 330 of the female connector, which is hand tightened, screws into the insert, applying a mating force and engaging the contacts of the male and female connectors. The insert and bolt are long to provide early engagement and prevent one circuit from contacting anothher during assembly. There is normally a clearance between the male and female connectors to permit full engagement of the contacts without bottoming the two connectors. The center bolt 130 in the female connector, is self locking. The bolt is retained in position in the female connector by a wire snap ring 330.

The outer end of the male and female connector has a molded plastic post 370 (part of the plastic shell) with a knob on the end. The wires, crimped to the sockets, pass through ⅛ inch of the plastic shell and bend inward toward the center post. The wires then bend up, parallel to the post. The wires are squeezed around the post by a ratchet nylon strap below the knob (shown as 380 in FIG. 2). This arrangement ties the wires to the male (and female) connectors and prevents any pull on the sockets.

Figure 4:
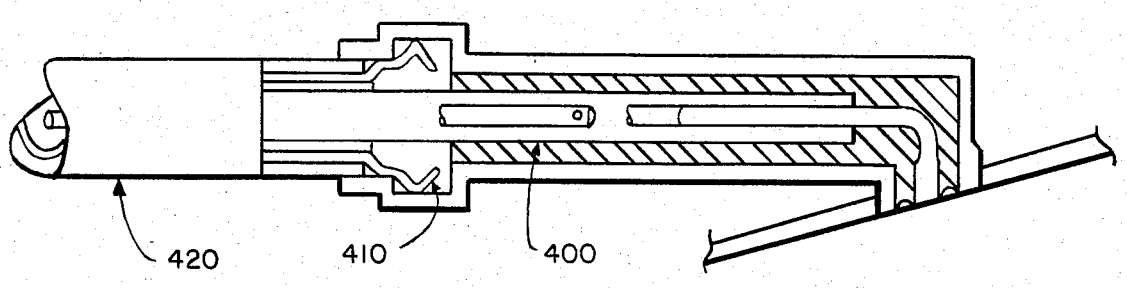
FIG. 4 is an illustration of crimp wire locking sockets adapted for use in the present invention.

The crimp wire locking sockets as illustrated in FIG. 4 are sockets crimped to the wires which have added chamfer on the large diameter of the socket. The retaining clips are designed to engage the chamber. This arrangement does not require tools for installation or removal. The sockets can not be pushed out. The latching feature of the sockets to the connector is as described above.

There are two methods of sealing the wires to the plastic connector. In method 1, the wires are a relatively close fit (a few thousand gap) in the plastic connector. Sealing the wires can be accomplished by applying a thin layer of sealing compound around the wires on the connector surface. This would seal the wires to the connector by filling the gap between the wires and the connector. Note that this is not the same as potting a connector where the potting compound was built up around the terminals and the wires. The potting method made changing wires almost impossible. The thin layer of sealant will separate when the wires and sockets are removed from the connector.

In method 2, a thin resilient silicone individual wire seal is pulled over the wire insulation. The wire insulation and seal are coated with a silicone lubricant. After the wire and socket are installed in the connector and latched, the seal is slid down the wire, into the connector cavity and latches between the end of the insulation and socket.

There are two 'O' ring seals. One that seals the male connector to the female connector 340 and the other that seals the center attach-bolt to the female connector 330. This is presented in FIG. 3.

An indexing key 380 is provided in the form of a section of the outer edge of the male connector which is cut back, while a similar section of the outer section of the female connector is extended into the cutout area of the male connector. This arrangement forms a key for indexing the male and female connectors. The key provides a positive index of all contacts.

The wire and sockets of the male and/or female (crimp type) connectors may be installed or removed without disconnecting the male and female connectors. When connector shielding is required, the outside of the female connector can be metalized, or a thin metal shield can be attached to the outside of the female connector.

Figure 5:
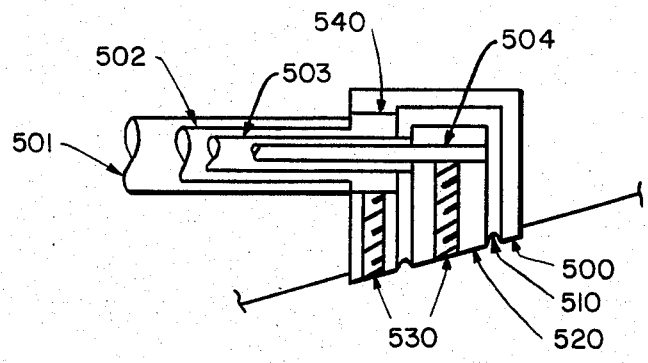
FIG. 5 is an illustration of a screw wire attachment adapted for use in the present invention.

A 3 ½ inch diameter cone connector with 363 (crimp) contacts has also been developed. The details of the 3 ½ inch diameter connector are identical to the 2 ½ inch diameter connector except for connector size and number of contacts. A 2 29/32 inch diameter (screw wire attachment) connector was also developed. The 2 29/32 inch diameter connector is basically the same as the 2 ½ inch diameter connector except for the screw attachment of the wires to the contacts, the number of contacts, and the wire arrangement. There are 7 levels of contacts and sockets. The contacts of one level connect with the same level of (wire) sockets. In the screw (wire attachment) arrangement illustrated in FIG. 5, the number of contacts in each level, are identical to all other levels. The number of contacts per level in the 2 29/32 inch diameter connector are noted below in Table 2.

TABLE 2

| level | No of contacts | Male connector sockets | Female connector sockets |
|---|---|---|---|
| 1 | 22 | 22 | 22 |
| 2 | 22 | 22 | 22 |
| 3 | 22 | 22 | 22 |
| 4 | 22 | 22 | 22 |
| 5 | 22 | 22 | 22 |
| 6 | 22 | 22 | 22 |
| Total | 132 | | |

As mentioned above, the wire insulation extends ⅛ inch into the plastic shell. The bare wire extends from the end of the insulation through the hole in the plastic shell and into the (screw) contact. The self locking screw contact 300, is tightened against the wire.

As shown in FIG. 3, a shrink tubing cover 320 is installed on the outer circumference of the female connector. The cover seals the screw terminals of the female connector. A 3 29/32 inch diameter cone connector with 248 (screw) contacts has also been developed. The details of the 3 29/32 inch diameter connector are identical to the 2 29/32 inch diameter connector except for connector size and number of contacts.

Advantages of the electrical cone connector, of the present invention are as follows. Zero engaging or separating force for installing the male connector to female connector regardless of the number of contacts. No bent or broken pins occur. Wires may be easily removed from either the male or the female connector without the use of tools and without disconnecting the male from the female (crimp type) connector. Larger number of contacts per connector due to the installation of the contacts near the outer circumference rather than having the connector attachment on the outside. Contacts of one circuit can not touch the contacts of another circuit during installation due to the long center attach bolt arrangement and the key. The connector is a light weight construction. Pins and/or sockets can not be pushed out during installation with the cone connector construction. Coaxial or shielded contacts may be used with the cone arrangement in combination with all sizes of contacts.

Since the contacts engage face to face, the cone arrangement can probably be adapted to fiver optics. There is a very small air gap between the installed connectors with seals between the connectors and seals around the contacts. Three to six times as many contacts may be installed in one connector without the disadvantages of the present connectors.

The wire post 370 and nylon straps 380 provide a very secure attachment of the wires to the connector. The electrical cone connector may be used as an umbilical connector for stores, missiles, etc., with the addition of a ball type latch in the center attach bold.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. An electrical connector for connecting a first set of wires with a second set of wires, said electrical connector comprising:

a male plug which has a center and receives said first set of wires in a plurality of sockets on one end, and has a conically shaped mating surface on its other end, said male plug having an outer surface with a longitudinal indentation;

a female socket which has a center and receives said second set of wires in a plurality of sockets on a projecting annular surface at one end, and has a concave conical surface on its other end with interior dimensions complementary to the conically shaped mating surface of the male plug;

a first set of contacts distributed radially and longitudinally in a plurality of annular layers in the conically shaped mating surface of the male plug, each of said first set of sockets being connected to one of said first set of wires inserted in the plurality of sockets in the male plug, said first set of sockets having first engagement surfaces imbedded in the conically shaped mating surface of the male plugs, said first set of contacts comprising a plurality of screw contacts which receive and are connected to the first set of wires as they enter the sockets in the male plug, the screw contacts in the male plug each having a first outer contact which extends onto the conically shaped mating surface of the male plug and a first screw contact which extends through the first outer contact into the male plug to contact one of the first set of wires;

a second set of contacts distributed radially and longitudinally in a plurality of annular layers in the concave conical surface of the female socket, each of said second set of contacts being connected to one of said second set of wires inserted in the plurality of sockets in the female socket, and having second engagement surfaces imbedded in the concave conical surface of the female socket to electrically connect with one of the first set of sockets when the male plug and female socket are engaged, said second set of contacts comprising a plurality of screw contacts which receive and are connected to the second set of wires as they enter the sockets in the female socket, the screw contacts in the female plug each having a second outer contact on the concave conical surface of the female socket serving as the second engagement surface and a second screw contact which extends through the second outer contact into the female socket to contact with one of second set of wires;

an insert attached to the male plug at an orifice within its conically shaped mating surface, at its center;

a self locking center bolt having a threaded end and a head, said threaded end projecting through an orifice in the female socket to be screwed into the insert at the center of the male plug when the male plug and female socket are engaged, the head of the self locking center bolt remaining outside of the orifice at the end of the female socket which receives the second set of wires and pressing the female socket towards the male plug when the threaded end of the self locking center bolt is screwed into the insert, the self locking center bolt and insert thereby providing early engagement and preventing the first and second set of contacts from prematurely touching each other during assembly; and an indexing key fitting between a section of an outer edge of the male plug and a section of the female socket, said indexing key providing annular alignment between all the first and second set of contacts by aligning the male plug with the female socket; said indexing key being a protrusion connected to and aligned longitudinally along the projecting annular surface of the female socket so that it is parallel with the self locking center bolt, said protrusion fitting into the longitudinal indentation in the male plug when the male plug is engaged with the female socket to annularly align the first and second set of contacts so that they contact each other in corresponding pairs when the male plug and female socket are engaged.

2. An electrical connector, as defined in claim 1, wherein said female socket includes a means for sealing the electrical connector when the male plug and female socket are engaged, said sealing means preventing moisture from entering the electrical connector.

3. An electrical connector, as defined in claim 2, wherein said female socket includes a first and second annular notch around the interior of its concave conical surface, said first annular notch circumscribing the self locking center bolt as it projects through the female socket, and the second annular ring circumscribing the male plug at its widest point.

4. An electrical connector, as defined in claim 3, wherein said sealing means includes a first and second 'O' shaped ring, said first 'O' shaped ring being placed in said first annular slot and sealing any spaces around the self locking center bolt, and said second 'O' shaped ring being placed in said second annular slot and sealing spaces around the male plug as it engages the female socket.

* * * * *